US005618218A

United States Patent [19]

Klimenko

[11] Patent Number: 5,618,218

[45] Date of Patent: Apr. 8, 1997

[54] INFLATABLE WATER TOY

[75] Inventor: Konstantin Klimenko, Santa Monica, Calif.

[73] Assignee: Sevylor U.S.A., Inc., Los Angeles, Calif.

[21] Appl. No.: 505,156

[22] Filed: Jul. 21, 1995

[51] Int. Cl.[6] ..... A63H 27/10; B63C 9/08

[52] U.S. Cl. ..... 446/220; 441/113

[58] Field of Search ..... 446/220, 226, 446/222, 224, 369, 390, 368, 268; 441/108, 113, 123

[56] References Cited

U.S. PATENT DOCUMENTS

| | | | |
|---|---|---|---|
| 1,833,697 | 11/1931 | Walus | 441/113 |
| 1,916,527 | 7/1933 | Pastir | 446/220 |
| 3,994,102 | 11/1976 | Johnson et al. | 446/220 X |
| 4,529,390 | 7/1985 | Levy et al. | 446/220 |
| 4,964,827 | 10/1990 | Rudy | 446/220 X |

*Primary Examiner*—Mickey Yu

*Attorney, Agent, or Firm*—Knobbe, Martens, Olson & Bear, LLP

[57] ABSTRACT

Disclosed is an inflatable water toy, which includes an elongate tubular body. An aperture is provided through a first end of the tubular body, and the aperture is dimensioned to slidably receive the second end of the tubular body therethrough. Advancing the second end of the tubular body through the aperture forms a continuous loop, which may be continuously adjusted such as by cinching to adjust the loop to any of a wide variety of loop diameters, such as for positioning about the waist of a user.

4 Claims, 1 Drawing Sheet

INFLATABLE WATER TOY

BACKGROUND OF THE INVENTION

The present invention relates to inflatable water toys and, in particular, an elongate tubular water toy that can be configured into a loop, and continuously adjusted throughout a range of loop diameters.

A variety of inflatable water toys are known, in which one or more chambers are formed within an outer flexible wall. Inflation of the chamber with air causes the outer wall to assume its predetermined configuration. Examples in the prior art include air mattresses, beach balls, and a variety of other specialized configurations.

An entirely separate class of flotation devices include buoyant life-saving devices. These generally comprise foams, air bladders, and other buoyant components constructed into the form of a jacket or vest and adapted to be securely fastened to the wearer. Such buoyant flotation devices are well known in a variety of industries such as the sporting goods industry, and are commonly marketed for such activities as boating, water skiing, fishing and the like.

In general, the inflatable water toys tend to be things that the user balances on top of, such as an inflatable mattress, or that the user must hang onto with one or both hands during use. Although inflatable toys are no substitute for life-saving flotation devices, there remains a need for an inflatable toy which can be readily secured to the user such that the user's hands are free for other activities. In addition, there remains a need for such an inflatable toy which can be adjusted to fit any of a wide variety of users, such as by wrapping around the waist or around the chest of the user. In addition, there remains a need for such an inflatable toy which can be interlinked with other similar toys to produce unique buoyant configurations.

SUMMARY OF THE INVENTION

There is provided in accordance with one aspect of the present invention an inflatable water toy. The water toy comprises an elongate tubular body having a head portion on a first end of the body and a tail portion on a second end of the body. An aperture is provided through the head portion of the body and the aperture is dimensioned with respect to the cross-sectional configuration of the tail portion of the body to slidably receive the tail portion therethrough.

In a preferred embodiment, the cross-section of the tubular body increases in the direction from the tail portion towards the head portion. The cross-section of the tubular body is generally greatest at the head portion.

In a particularly preferred embodiment, the inflatable water toy is configured to appear generally like a fanciful animal such as a snake, having an aperture through the head for slidably receiving the tail to form a loop which may be continuously adjustable to fit about the waist or chest of the user.

In accordance with another aspect of the present invention, there is provided an elongate tubular body having first and second ends. An aperture is provided through the body proximate the first end. The aperture comprises a generally cylindrical tubular wall extending through the body.

The aperture is adapted to slidably receive the second end of the tubular body therethrough, while providing resistance to removal of the second end therefrom.

In a preferred embodiment, the second end is provided with a portion having a relatively enlarged cross-sectional area compared to the adjacent cross-sectional area of the tubular body. The portion having an enlarged cross-sectional area functions as a releasable lock for inhibiting removal of the second end of the tubular body in a reverse direction through the aperture in the first end of the tubular body.

Further features and advantages of the present invention will become apparent from the detailed description of preferred embodiments which follows, when considered together with the attached drawings and claims.

DETAILED DESCRIPTION OF THE PREFERRED EMBODIMENT

Figure 1:
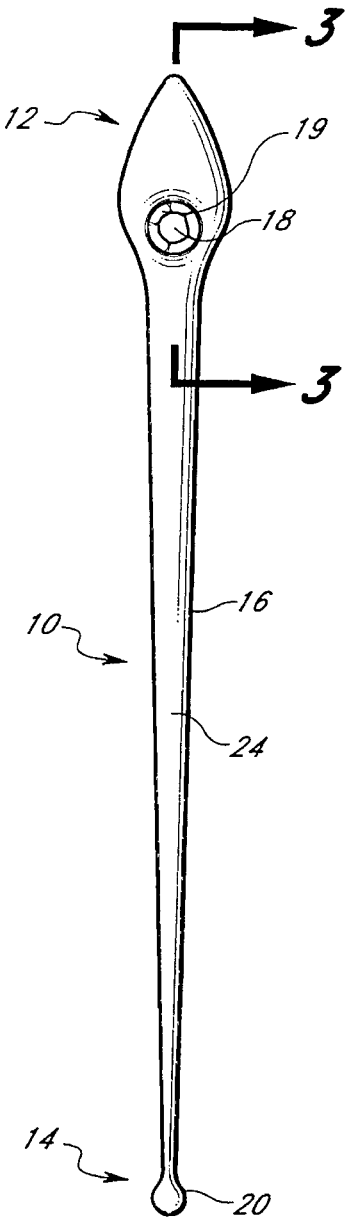
FIG. 1 is a top plan view of an embodiment of the present invention.

Referred to FIG. 1, there is disclosed a schematic plan view of one preferred embodiment of the present invention. It is to be understood that although the preferred embodiment of the present invention takes the form of a fanciful snake, a wide variety of alternate specific configurations can readily be devised, which incorporate the features of the present invention. The present invention is thus not intended by the inventor to be limited to expression in the form of an inflatable serpent or snake.

In the embodiment illustrated in FIG. 1, there is provided an inflatable body 10 generally having a first end 12 and a second end 14. An elongate tubular section 16 is disposed in between the first end 12 and second end 14.

Located somewhere in between the first end 12 and the second end 14 is an aperture 18 extending through the inflatable body 10. The aperture 18 has a cross-sectional area which is adapted to slidably receive at least a portion of the tubular section 16 as will be discussed infra.

In a preferred embodiment, the tubular section 16 has a generally decreasing cross-sectional area in the direction away from the first end 12 and towards the second end 14. Preferably, the second end 14 is provided with an anchor 20, which is an inflatable region of the inflatable body 10 which has a larger cross-sectional dimension than the adjacent tubular section 16.

A valve 22 is positioned somewhere along the inflatable body 10, such as on the anchor portion 20. The valve preferably permits inflation of the water toy by mouth, as is well known in the art.

In use, the inflatable body 10 is adapted to be curved into a loop or folded back upon itself so that the second end 14 is positioned near the first end 12. The second end 14 and, when provided, the anchor 20, is advanced through the aperture 18 to form a closed geometric figure as illustrated in phantom in FIG. 2. The user can thus wrap the water toy around their waist, shoulders, legs, or otherwise, and draw the second end 14 through the aperture 18 and cinch the diameter of the inflatable body 10 down to the desired size, such as one might tighten an adjustable belt. In this manner, the user can "wear" the water toy in a manner that enhances the user's buoyancy in the water.

The inflated cross sectional diameter of the tubular section 16 is proportioned relative to the diameter of the aperture 18 to provide a sliding friction which releasably resists pulling the second end 14 back out of the aperture 18 in a reverse direction. In addition, in an embodiment having an anchor 20, the anchor provides a final, stronger resistance to removal of the second end 14 from the aperture 18. However, due to the inherently compliant nature of the inflatable toy, the anchor 20 can be forced through the aperture 18 by deformation under the influence of a sufficient detachment force as will be readily understood by those of skill in the art.

The inflatable body 10 can take any of a wide variety of configurations without departing from the spirit of the present invention. For example, the body can be conformed into any of a wide variety of animals, such that the second end 14 corresponds to a tail, foot, fin, or other anatomical structure of the animal. Alternatively, the second end 14 can correspond to the head of an inflatable animal, which is adapted to wrap around the user and advance through an aperture positioned at a different portion of the animal.

In addition, any of a variety of non-animal configurations such as arbitrary configurations or regular 3-dimensional geometric forms can be used.

The elongate tubular section 16 in the preferred embodiment has a generally circular or oval cross-sectional configuration, such as that which inherently results from the method of manufacturing discussed infra. However, any of a variety of other cross-sectional configurations can be readily devised, such as rectangular, square, arbitrary, or others, depending upon the manufacturing technique and desired end product.

In general, the elongate tubular section 16 tapers from a larger diameter near the first end 12 towards a smaller diameter at the second end 14. The taper can be regular or irregular, as desired. Alternatively, the tubular section 16 can be provided with a substantially constant cross-sectional configuration throughout most or all of its axial length.

The anchor 20 can also take any of a variety of configurations, as appropriate for the desired configuration of the inflated water toy. For example, in the illustrated snake or serpent embodiment, the anchor has been formed into the general configuration of a sphere or ellipse. Alternatively, the anchor 20 can take the form of a radially outwardly extending annular ring, such as that which is commonly found on the handle end of a baseball bat. Alternatively, the anchor 20 can comprise a generally T-shape or other configuration which may be radially symmetrical or asymmetrical as desired. The specific finished configuration of the anchor 20 is largely dictated by the intended artistic appearance of the final product, and will achieve its intended goal so long as it provides an interference fit through the aperture 18, and thereby increases the force required to withdraw the second end 14 from the aperture 18.

The aperture 18 is generally configured relative to the tubular section 16 so that the tubular section 16 can be drawn through the aperture 18 to form a loop which is continuously adjustable throughout a range of diameters sufficient to include the waist size or shoulder size of the intended users. Preferably, the uncompressed diameter of the tubular section 16 is somewhat larger than the native diameter of the aperture 18, to provide resistance to movement except when the user intends to adjust the inflatable water toy.

The coefficient of static friction or coefficient of sliding friction of the tubular section 16 with the interior surface 19 of aperture 18 can be modified in any of a variety of ways, as will be apparent to those of skill in the art. For example, reducing the inside diameter of aperture 18 relative to the uncompressed outside diameter through tubular section 16 will tend to increase the friction encountered which cinching the inflatable water toy to the desired loop diameter. Alternatively, any of a variety of surface structures can be provided on the tubular section 16 which provide an interference fit with the aperture 18. Such surface structures may be provided solely for the purpose of enhancing friction, such as corrugations, ridges or the like, or may contribute to the artistic design of the inflatable water toy, such as a row of fins or spikes along the tubular section 16. Alternatively, the material of the inflatable water toy along tubular section 16 can be selected such that it has a relatively high coefficient of static friction when in contact with the material lining the interior surface 19 of aperture 18. Materials which are more or less slidable when placed in contact with each other under water can be readily selected by one of ordinary skill in the art through routine experimentation.

The aperture 18 can be located anywhere along the inflatable body 10, provided that it enables the formation of a loop between the aperture 18 and the second end 14. In general, the present inventor has determined that location of the aperture in a relatively larger diameter section of the inflatable body 10 improves rupture resistance and, in the snake embodiment, the aperture is therefore preferably located in or about the enlarged head portion at the first end 12.

In an alternative embodiment, two or more apertures 18 are provided along the inflatable body 10. This configuration allows the user a choice when forming a closed loop, as may be desired for comfort or other reasons.

The inflatable body 10 can be manufactured in accordance with any of a wide variety of manufacturing techniques that will be readily apparent to those of skill in the art. In accordance with one preferred manufacturing technique, a top layer 24 and a bottom layer 26 of a thin, generally air-impermeable material are positioned one of top of the other, and cut such as by die cutting into the desired configuration. The peripheral edges of the top and bottom layer are thereafter sealed together, such as by high frequency welding, adhesives, solvent bonding, or any of a variety of other techniques known in the art, to provide peripheral seam 28.

Alternatively, embodiments of the present invention can be produced from a single sheet of pliable material by folding the sheet back upon itself and sealing it into a tubular body or other configuration having a single seam. More than one sheets can also be used as will be apparent to one of skill in the art, such as three sheets to construct a triangular body having three seams, or tour sheets or more as may be desired. In general, fewer pieces and fewer seams simplifies the construction process, but more pieces and seams may be desirable for more complex shaped finished products.

The manner of providing and securing inflation valves on inflatable water toys is well within the skill in the art.

The aperture 18 can also be formed in a variety of ways. For example, the aperture 18 can be punched through the top layer 24 and bottom layer 26, and welded around its circumference to form a seam much like the outer periphery of the inflatable body 10. Alternatively, such as in the case of a thicker main body, a separate generally cylindrical or other tubular wall 30 can be preformed, having a first end 32 circumferentially bonded to the top layer 24 of the inflatable body 10 and a second end circumferentially bonded to the bottom layer 26 of the inflatable body 10. This configuration permits a deeper aperture, and consequently thicker inflated dimension of the toy in the area of the aperture 18. Such techniques are well known in the art and have long been used in connection with the manufacture of air mattresses known as the "french mattress."

In one preferred embodiment, the top layer and bottom layer of the inflatable body 10 comprise a polyvinyl chloride film. There is no particular best mode with respect to layer thickness and other specific characteristics, and any of the wide variety of soft, pliable plastics well known in the inflatable water toy art may be used. The blank sheetstock before cutting the serpent profile for each of the top and bottom layers was approximately 80 inches long by 10 inches wide.

Alternatively, any of a wide variety of polymer sheets or films, including both relatively inelastic films such as PVC or polyethylenes and relatively elastic films such as latex based elastomers can be used. Woven and nonwoven fabrics, coated or treated to minimize air permeability can also be used. In general, any material that can be formed into layers which permit a sufficient retention of inflation air for use in the intended use environment may be used. As a further alternative, the buoyant water toy of the present invention can be formed from a substantially solid foam such as neoprene or other flexible foam which will both float and exhibit sufficient flexibility to permit the looping and cinching functions described previously.

In a preferred embodiment configured in the form of a snake, the overall inflatable water toy length was approximately 77 inches. Excluding the anchor portion 20, the overall length was about 72 inches. The width of the cut sheet stock through the anchor region 20 was about 4½ inches, and the width through the tubular section 16 adjacent the anchor 20 was about three inches. The width of the sheet stock through the tubular section 16 adjacent the first end 12 was about 5½ inches, and the maximum width through the first end 12 was about eight inches.

The axial length of the "head" at first end 12 was about 11 inches, with about nine inches from the tip of the first end 12 to the center of the aperture 18. The aperture was provided with a diameter of about three inches, and an axial length of about 3 inches.

Figure 2:
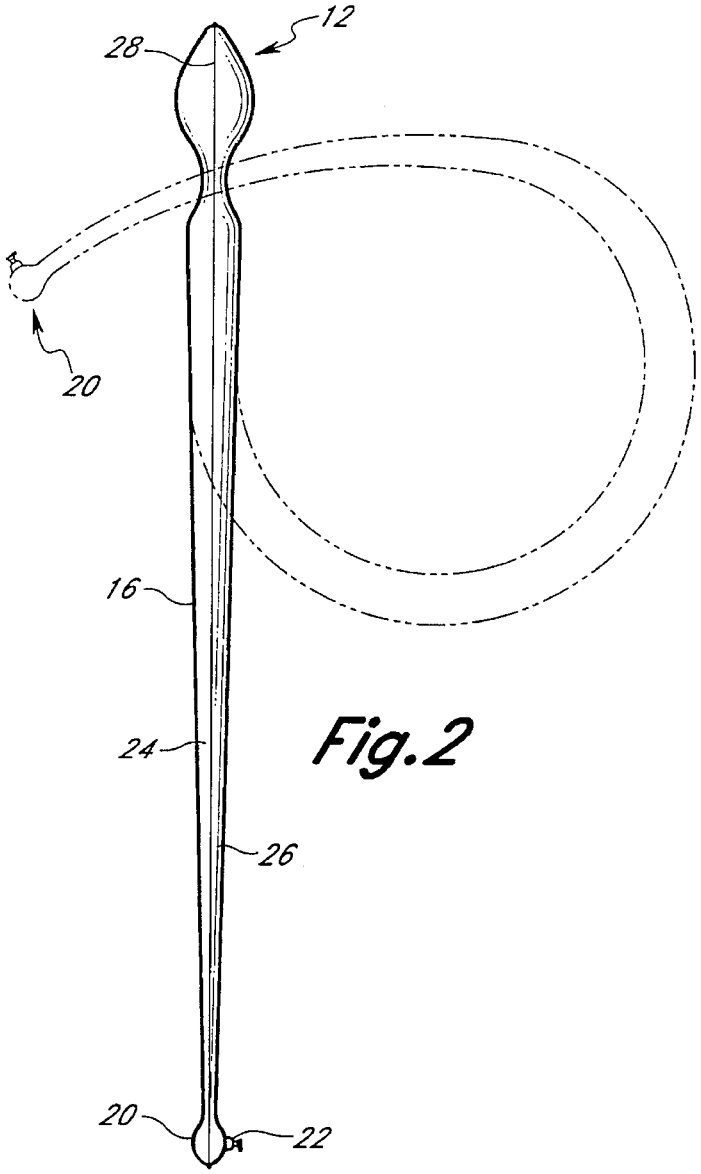
FIG. 2 is a side view of the embodiment of FIG. 1, showing the looped configuration in phantom.
Figure 3:
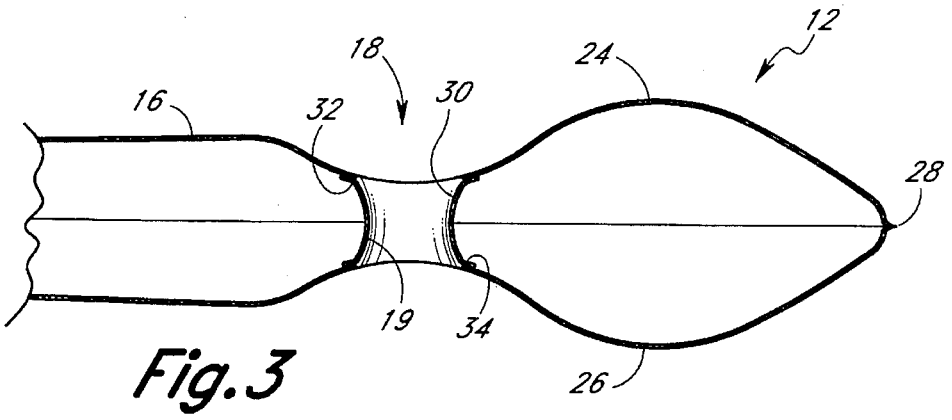
FIG. 3 is an elevational cross sectional view taken along the lines 3—3 in FIG. 1.

The overall length and other dimensions of water toys constructed in accordance with the present invention can be varied widely depending upon the ultimate intended configuration and use of the product. For example, the snake illustrated in FIGS. 1 through 3 is intended for use such as by wrapping around the waist or chest of the wearer. Thus, the length along the inflatable body between the aperture 18 and the second end 14 should be sufficient to wrap around the waist of any reasonably foreseeably dimensioned wearer and may therefore be as low as about 24 inches or smaller. Preferably, however, the length between the aperture 18 and the second end 14 is in excess of about 36 inches, and, more preferably, in excess of about 48 inches to provide a sufficient free length of second end 14 extending beyond the aperture 18 when in use. Alternatively, embodiments of the present invention can be configured for use such as wrapping around the wrists, arms, or ankles of the user, in which case the overall length between the aperture 18 and the second end 14 may be less than 24 inches, such as 18 inches or 12 inches or smaller.

As will be appreciated by those of ordinary skill in the art, the dimensions, materials, construction techniques and other details identified above can be varied widely by those of skill in the art to produce any of a wide variety of variations within the spirit of the present invention. Such variations in view of the disclosure herein are expressly contemplated by the inventor to come within the scope of the present invention, and the scope of the present invention should therefore be evaluated with reference to the attached claims and not limited to the preferred illustrated embodiment.

I claim:

1. An inflatable water toy, comprising:

an elongate tubular body which tapers from a larger diameter near a first end thereof to a smaller diameter near a second end thereof;

a head portion on the first end of the body;

a tail portion on the second end of the body; and an aperture through the head portion of the body, said aperture dimensioned to slidably receive the tail portion therethrough, and wherein the tubular body is configured to be formed into a loop when the second end is inserted through the aperture, and wherein the diameter of the loop is continuously adjustable throughout a range of diameters.

2. An inflatable toy, comprising:

an elongate tubular body having first and second ends;

an aperture through the body, said aperture comprising a generally cylindrical tubular wall extending through the body, wherein said aperture is adapted to slidably receive the second end of the tubular body therethrough, and wherein the tubular body is configured to be formed into a loop when the second end is inserted through the aperture, and wherein the diameter of the loop is continuously adjustable throughout a range of diameters;

a valve on the body for retaining air therein; and a lock on the second end of the tubular body to provide resistance against removal of the second end from the aperture;

wherein the uncompressed diameter of the tubular body is larger than the diameter of the aperture to provide resistance to movement between the tubular body and the aperture when the inflatable toy is formed into said loop.

3. An inflatable toy as in claim 2, wherein said tubular body is formed from a bottom layer of a first flexible material bonded to a top layer of a second flexible material.

4. An inflatable toy as in claim 3, wherein both of said first and second materials comprise polyvinylchloride.

* * * * *